US011369194B1

(12) United States Patent
Seaborn

(10) Patent No.: US 11,369,194 B1
(45) Date of Patent: Jun. 28, 2022

(54) DESK ATTACHMENT APPARATUS AND SYSTEM TO ELIMINATE DROPPED ITEMS, PROVIDE WIRE MANAGEMENT, AND SUPPORT FOR FUNCTIONAL AND ARTISTIC DISPLAYS

(71) Applicant: SEABORN DEVELOPMENT LLC, Longmont, CO (US)

(72) Inventor: John Seaborn, Longmont, CO (US)

(73) Assignee: SEABORN DEVELOPMENT LLC, Longmont, CO (US)

( * ) Notice: Subject to any disclaimer, the term of this patent is extended or adjusted under 35 U.S.C. 154(b) by 0 days.

(21) Appl. No.: 17/151,281

(22) Filed: Jan. 18, 2021

(51) Int. Cl.
*A47B 21/06* (2006.01)

(52) U.S. Cl.
CPC ..... *A47B 21/06* (2013.01); *A47B 2200/0082* (2013.01); *A47B 2200/0085* (2013.01)

(58) Field of Classification Search
CPC ..... A47B 21/06; A47B 2200/0082; A47B 2200/0085; A47B 2097/003; F16L 3/223; H02G 3/305
USPC ..... 312/351.1, 223.3, 223.6, 196; 248/49, 248/65, 68.1, 72, 73; 108/50.01, 50.02, 108/28
See application file for complete search history.

(56) References Cited

U.S. PATENT DOCUMENTS 3,696,920 A * 10/1972 Lahay ..... A61B 50/30 206/370
3,819,039 A * 6/1974 Erickson ..... A61B 17/06061 428/167
4,036,289 A * 7/1977 Cheng ..... F28F 9/0132 165/172
4,094,561 A 6/1978 Wolff et al.
4,535,703 A * 8/1985 Henriott ..... H02G 3/045 108/50.02
5,860,681 A * 1/1999 Slais ..... F16L 41/086 285/137.11
5,927,041 A * 7/1999 Sedlmeier ..... E04B 9/064 52/39

(Continued)

FOREIGN PATENT DOCUMENTS

DE 202007013436 * 11/2007
EP 0594287 * 4/1994

(Continued)

OTHER PUBLICATIONS https://lifehacker.com/build-a-simple-hanging-cord-organizer-from-foam-rubber-5902998/amp (Year: 2012).*

*Primary Examiner* — Janet M Wilkens
(74) *Attorney, Agent, or Firm* — Patrick Stanzione; Stanzione & Associates, PLLC

(57) ABSTRACT

A desk attachment apparatus and system that prevents items from falling off a desk top, to provide electrical wire management, and provides support for functional and artistic displays. The apparatus includes a body with a plurality of holes of to receive and retain electrical wires, a plurality of slits in which the wires can be inserted into the holes, a front groove configured to tightly cover a protruding edge of a desk top and back groove extending along a back face of the body to receive an insert to block wires from being removed from the holes through the slits. Also included is an extension member that can be inserted in the back groove of the desk dam attachment apparatus to extend the desk dam apparatus.

18 Claims, 9 Drawing Sheets

(56) References Cited

U.S. PATENT DOCUMENTS

| | | | | |
|---|---|---|---|---|
| 6,227,502 | B1 * | 5/2001 | Derman | F16L 3/2235 248/68.1 |
| 6,254,206 | B1 * | 7/2001 | Petrick | A47B 21/06 108/50.02 |
| 6,736,669 | B1 * | 5/2004 | Martin | H02G 3/32 439/607.41 |
| RE38,709 | E * | 3/2005 | Gutgsell | H02G 3/0437 108/50.02 |
| D691,875 | S * | 10/2013 | Ganski | D8/356 |
| 2004/0118982 | A1 * | 6/2004 | Shillings | F16L 3/223 248/68.1 |
| 2005/0077436 | A1 * | 4/2005 | Nelson | F16L 3/223 248/68.1 |
| 2005/0189453 | A1 * | 9/2005 | DeGuevara | H02G 3/305 248/68.1 |
| 2008/0029656 | A1 * | 2/2008 | Feehan | A47B 21/06 248/65 |
| 2009/0065249 | A1 * | 3/2009 | Silvers | H02G 3/305 174/72 A |
| 2009/0255702 | A1 | 10/2009 | Mitchell | |
| 2011/0147542 | A1 * | 6/2011 | Hoek | H02G 3/32 248/68.1 |
| 2011/0248125 | A1 * | 10/2011 | D'Andria | A61M 5/1418 248/65 |
| 2018/0319619 | A1 * | 11/2018 | Frierson | H02G 3/305 |

FOREIGN PATENT DOCUMENTS

| | | | |
|---|---|---|---|
| GB | 2333649 | * | 7/1999 |
| KR | 20130129161 | * | 11/2013 |
| WO | 2020146060 | * | 7/2020 |

* cited by examiner

DESK ATTACHMENT APPARATUS AND SYSTEM TO ELIMINATE DROPPED ITEMS, PROVIDE WIRE MANAGEMENT, AND SUPPORT FOR FUNCTIONAL AND ARTISTIC DISPLAYS

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept relates to a desk top attachable apparatus and system that can be attached to an edge of a desk top to manage electrical wires and to prevent the electrical wires from falling into a gap between the desk and a wall, and to keep the wires in an organized and separated fashion on a surface of the desk top.

The present inventive concept also relates to a desk top attachable apparatus and system that can be attached to an edge of a desk and to receive multiple objects therein by inserting a portion of the objects therein to support the objects in a vertically standing position above the surface of the desk top.

The present inventive concept also relates to a desk top attachable apparatus and system that can be attached to an edge of a desk top to provide a dam between an edge of the desk and a wall in which the desk may be placed adjacent thereto in order to prevent objects from falling into a gap existing between the edge of the desk top and the wall.

2. Description of the Related Art

Wires for electrical devices such as computers, mobile phones, mobile phone chargers, monitors, Ipads®, etc., are required to extend from an electrical outlet to a surface of a desk top in order to feed electricity to such electrical devices, which generally rest on the desk top while being electronically operated or charged. When such wires extend from an electrical outlet to the desk top, these wires often become twisted between each other and tangled up, and are then difficult to untangle, and sometimes require a substantial amount of time to untangle. Such wires are also prone to continuously sliding off the desk top as a result of a gravitational pull on the wires, often sliding between the desk and a wall in which the wires are being electronically charged, making it difficult to retrieve the wires and place them back on the desk top, only to slide back off the desk top. Some attempts to manage electrical wires at a desk are listed below, as follows.

Mitchell (US Patent Publication No. 2009/0255702) describes an organizing and wire management apparatus that is an elongated tube-like structure 20 with a channel 24 extending along the length thereof. Wires can be fed through the structure 20, and a resilient strip 22 or cushion 22-A made of foam can be inserted into the structure 20 to hold wires in place. This tube-like structure 20 must be fastened to a leg or a surface of the desk with brackets 40 and screws 70 in order to keep the structure 20 secured to the desk or along a leg of the desk, or to prevent the structure 20 from moving around on the desk. Alternatively, this structure 20 requires a stand 81 in which the structure 20 is inserted in order to keep the structure upright on a floor or other surface. Further, it requires a substantial amount of time and labor to feed electrical wires through the structure 20 and along the resilient strip 20 and out of the channel 24.

Wolff et al. (U.S. Pat. No. 4,094,561) describes a wiring enclosure device 12 for desks. This enclosure is in the form of an elongated tubular enclosure that becomes mounted at a rear edge of a desk. More specifically, this device includes a flange 20 that extend along a top surface of a desk, while the tubular enclosure to hold wires therein, while the flange 20 rests on a surface of a desk. The flange 20 requires screws 23 to be inserted therethrough in order to maintain the device at an edge of a desk. A flexible wiper strip 25 is required to be inserted into an inner recess under a lip 16 and must be either adhered thereto with an adhesive or heat welded. This wiper strip 25 includes a thin lower edge 26 which lays on the desk top surface as illustrated in FIGS. 1 and 3. Wolff et al. requires gluing a wiper strip 25 to the body 12 of the enclosure as well as screwing a flange 20 to a surface of a desk in order to maintain the device 12 in place at an edge of a desk.

There is a need for an easily attachable and detachable device and system, to a desk top surface, that can receive electrical wires extending from an electrical outlet and hold these electrical wires on the desk top surface while keeping these wires separate and tangle free.

There is also a need for an easily attachable and detachable device and system, to a desk top surface, that can receive portions of objects desired to be seated on the desk top surface such that these objects remain vertically upright in a desirable and artistic fashion.

There is also a need for an easily attachable and detachable device and system, to a desk top surface, that can remain seated between the desk top edge and a wall in which the desk is placed adjacent thereto to prevent objects, such as pens, pencils, etc., from falling into a gap between the desk top surface and the wall.

SUMMARY OF THE INVENTIVE CONCEPT

The present general inventive concept provides an easily attachable and detachable device and system, to a desk top surface, which can receive electrical wires extending from an electrical outlet and hold these electrical wires on the desk top surface while keeping these wires separate and tangle free. The present general inventive concept also provides an easily attachable and detachable device and system, to a desk top surface, which can receive portions of objects desired to be seated on the desk top surface such that these objects remain vertically upright in a desirable and artistic fashion. The present general inventive concept also provides an easily attachable and detachable device and system, to a desk top surface, which can remain seated between the desk top edge and a wall in which the desk is placed adjacent thereto to prevent objects, such as pens, pencils, etc., from falling into a gap between the desk top surface and the wall.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a desk top edge attachment apparatus to retain electrical wires above a surface of the desk top and in an organized manner and to receive and maintain display objects thereon in an upright manner, the apparatus comprising: a body including a predetermined length, width and height; a plurality of holes extending through a center portion from a top to a bottom thereof and spaced apart by a predetermined distance along the length thereof to receive and retain electrical wires therethrough; a plurality of slits corresponding with and aligned with respective ones of the plurality of holes, the slits extending from the respective hole through a back surface of the body; a first groove extending along a front face of the body along the length thereof to form a front top lip protruding above a top of the first groove and a front bottom lip protruding below a bottom of the first groove, the groove being configured to tightly cover a protruding edge of a desk top such that the lip protruding from the top thereof rests on a surface of the desk top; and a second groove extending along a back face of the body along the length thereof to form a lip protruding from a top of the second groove and a lip protruding from a bottom of the second groove, the second groove being configured to receive an insert formed of the same dimensions as the second groove to block wires received therein from being removed through the respective slit.

In an exemplary embodiment, desk top edge attachment apparatus further comprises an adhesive material attached along the length of a back wall of the first groove to adhere to a side edge of a desk top.

In another exemplary embodiment, the adhesive material is a double-sided tape.

In another exemplary embodiment, the adhesive material includes a strip of hooks and a strip of loops, each strip having an adhesive on a back side to stick to the back wall of the first groove or the side edge of the desk top.

In another exemplary embodiment, desk top edge attachment apparatus further comprises an insert having a height, length and width equal to the height, length and width of the second groove, the insert being configured to tightly fit into the second groove to close the slits.

In another exemplary embodiment, desk top edge attachment apparatus further comprises an extension member having a height and length equal to the height and length of the desk top edge attachment apparatus body, the extension member including: a protruding member which protrudes from a front surface and along a length thereof and is configured to have the same dimensions as the second groove and to be inserted into the second groove of the body of the desk top edge attachment apparatus; and a back groove formed in a back surface along a length thereof and configured to receive a protruding member of another extension member or an insert having the same dimensions as the protruding member.

In another exemplary embodiment the predetermined width of the body and lips is three inches at the top surface and at the bottom surface, and the width of the body is two inches from a back wall of the first groove to a back wall of the second groove.

In another exemplary embodiment the predetermined height of the body is two inches, such that the height of the front top and bottom lips are one half inch, the height of the back top and bottom lips are one half inch and the height of the first and second grooves are one inch.

The foregoing and/or other features and utilities of the present general inventive concept may also be achieved by providing a desk top edge attachment apparatus to retain electrical wires above a surface of the desk top and in an organized manner and to receive and maintain display objects thereon in an upright manner, the apparatus comprising: a body including a plurality of holes extending through a center portion thereof, each of the plurality of holes being spaced apart by a predetermined distance along a length thereof, the holes being configured to receive and retain electrical wires therethrough; a plurality of slits aligned with and corresponding with a respective one of the plurality of holes, the slits extending from the respective hole through a back surface of the body; a front upper lip protruding outward from a top portion of a front side thereof and along the length thereof; and a back groove extending along a back side thereof and along the length thereof to form an upper back lip protruding from a top portion of the body and a lower back lip protruding from a bottom portion of the body, the back groove being configured to receive an insert formed of the same dimensions as the back groove to block wires received in the holes from being removed through the respective slit.

In an exemplary embodiment, desk top edge attachment apparatus may further comprise an extension member having a height and length equal to the height and length of the desk top edge attachment apparatus body, the extension member including: a protruding member which protrudes from a front surface and along a length thereof and is configured to have the same dimensions as the back groove and to be inserted into the back groove of the body of the desk top edge attachment apparatus; and a back groove formed in a back surface along a length thereof and configured to receive a protruding member of another extension member or an insert.

In another exemplary embodiment the desk top edge attachment apparatus may further comprise a two-sided adhesive having the first side attached along the length of the front side of the body under the front upper lip and a second side configured to attach to a side of a desk such that the front lip rests on a desk top surface.

In another exemplary embodiment the predetermined width of the body and upper front and back lips is three inches, and the width of the body is two inches from the front side thereof under the front upper lip to a back wall of the second groove.

In another exemplary embodiment the predetermined height of the body is two inches, such that the height of the front top lip is one half inch, the height of the back top and bottom lips are one half inch and the height of the second groove is one inch.

The foregoing and/or other features and utilities of the present general inventive concept may also be achieved by providing a desk top edge attachment system to retain electrical wires above a surface of the desk top and in an organized manner and to receive and maintain display objects thereon in an upright manner, the apparatus comprising: a body including: a plurality of holes extending vertically through a center portion thereof along a length thereof, the plurality of holes being spaced apart by a predetermined distance and configured to receive and retain electrical wires therethrough; a plurality of slits corresponding with and aligned with respective ones of the plurality of holes, the slits extending from the respective hole through a back surface of the body; a front upper lip protruding outward from a top portion of a front side thereof and along the length thereof; and a back groove extending along a back side thereof and along the length thereof to form a back upper lip protruding from a top of the body and a back lower lip protruding from a bottom of the body; and an extension member having a height and length equal to a height and length of the desk top edge attachment apparatus body, the extension member including: a protruding member which protrudes from a front surface along a length thereof and is configured to be inserted into the back groove of the body of the desk top edge attachment apparatus; and a back groove formed in a back surface along a length thereof and configured to receive a protruding member of another extension member.

In an exemplary embodiment the system may further comprise a two-sided adhesive having the first side attached along the length of the front side of the body under the front lip and a second side configured to attach to a side of a desk such that the front lip rests on a desk top surface.

In another exemplary embodiment the system may further comprise an insert having a height, length and width equal to the height, length and width of the back groove of the body and the back groove of the extension to tightly fit into the back groove of the body to close off the slits and to tightly fit into the back groove of the extension.

In another exemplary embodiment the body has a width of two inches and a height of two inches, the front upper lip and back upper and lower lips protrude from the body by approximately one half inch and have a height of one half inch, and the back groove has a height of approximately two inches and a width of approximately one half inch.

In another exemplary embodiment the front groove has a height of one inch and a width of one half inch.

In another exemplary embodiment the system may further comprise an insert having a height, length and width equal to the height, length and width of the back groove of the body and the back groove of the extension to tightly fit into the back groove of the body to close off the slits and to tightly fit into the back groove of the extension.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1:
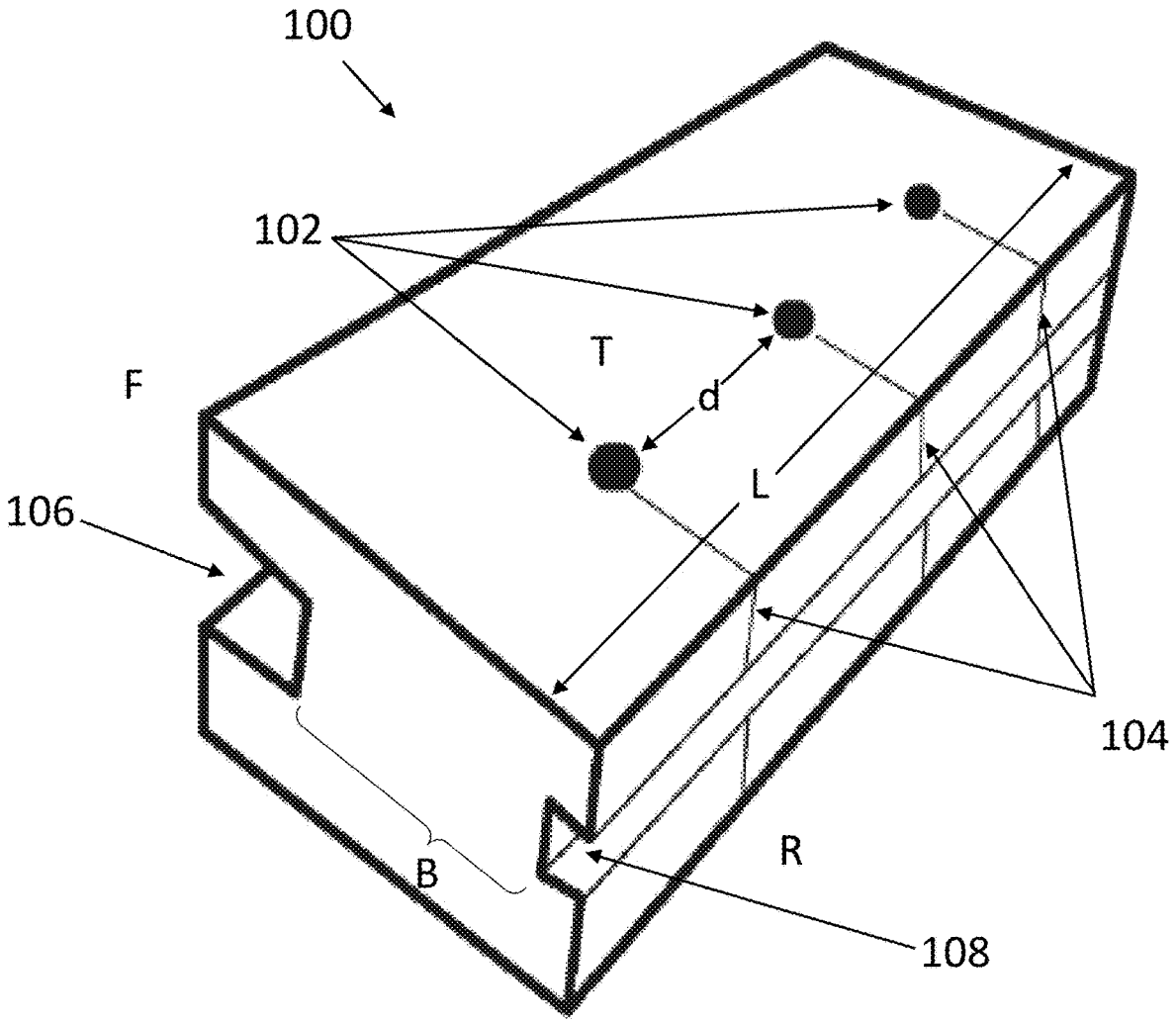
FIG. 1 illustrates a perspective view of a desk dam apparatus according to an exemplary embodiment of the present inventive concept.

The drawings illustrate a few exemplary embodiments of the present inventive concept, and are not to be considered limiting in its scope, as the overall inventive concept may admit to other equally effective embodiments. The elements and features shown in the drawings are to scale and attempt to clearly illustrate the principles of exemplary embodiments of the present inventive concept. In the drawings, reference numerals designate like or corresponding, but not necessarily identical, elements throughout the several views.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" may be used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein have to be defined based on the meaning of the terms together with the description throughout the specification.

Also, when a part "includes" or "comprises" an element, unless there is a particular description contrary thereto, the part can further include other elements, not excluding the other elements.

Hereinafter, one or more exemplary embodiments of the present general inventive concept will be described in detail with reference to the accompanying drawings.

Exemplary embodiments of the present general inventive concept are directed to FIG. 1 illustrates a perspective view of a desk dam apparatus 100 according to an exemplary embodiment of the present inventive concept. The apparatus 100 is referred to as a "desk dam" as the apparatus 100 is configured to be attachable to and detachable from an edge of a desk top of a desk in order to close any gap that may exist between the desk top and a wall in which such a desk may be placed adjacent thereto.

Figure 2A:
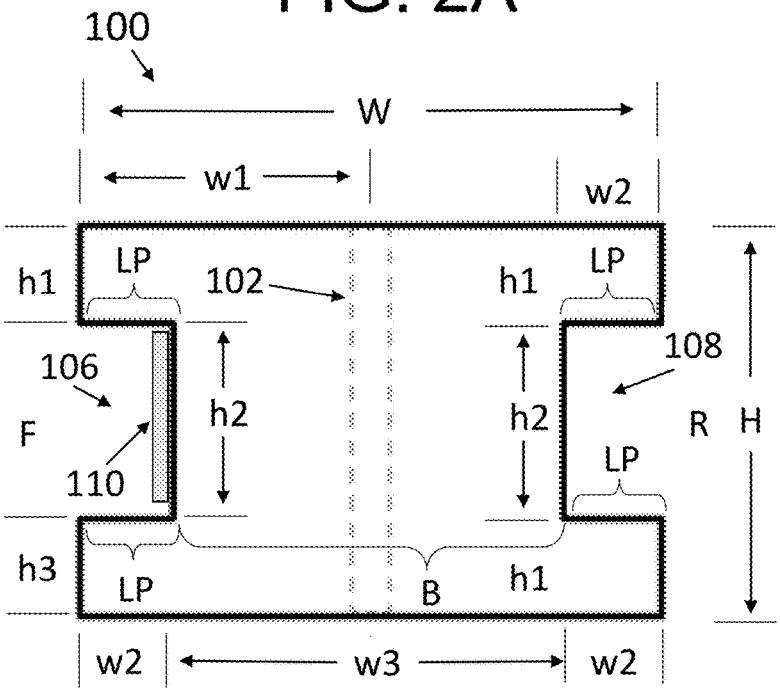
FIG. 2A illustrates a side view of the desk dam apparatus of FIG. 1.

The desk dam apparatus 100 may include a plurality of holes 102 equally distanced apart and along a length L thereof. The holes 102 may extend entirely through a middle of a body portion B of the desk dam apparatus 100 and from a top to a bottom thereof, as illustrated in FIG. 2A. The holes 102 are configured to have a diameter large enough to receive electrical wires therethrough, yet small enough to prevent electrical connectors at the ends of the wires from extending therethrough. The holes 102 can be formed to have a diameter of approximately 0.25 inches, and can be spaced apart from each other at a distance d of approximately 2 inches. However, the diameter of each hole 102 can be configured to correspond with diameters of wires intended to be used to electrically charge electronic devices seated on a desk top. Further, the distance d between adjacent holes 102 can be configured in accordance with the thickness/diameter of the wires intended to be used.

The desk dam apparatus 100 may also include a plurality of slits 104 that extend therethrough along a back portion thereof. The slits 104 can be configured to align with respective ones of the holes 102 such that an electrical wire can be slid through a slit 104 unit the wire reaches and rests in a corresponding hole 102. The slits 104 are provided to allow wires to be placed in a respective hole 102 while electrical connectors attached to an end of a corresponding wire are too large to fit through the hole 102.

The desk dam apparatus 100 may be configured to have a height H of approximately 2 inches from top to bottom thereof. The desk dam apparatus may also be configured to have a width W of approximately 3 inches from front F to rear R thereof. However, the height H and width W of the desk dam apparatus 100 can be configured to be larger or smaller depending on the desk top surface in which it is intended to be used therewith. For the purposes of describing an exemplary embodiment of the desk dam apparatus 100 herein, all references of the height H thereof will be inferred to be 2 inches, and all references to the width W thereof will be inferred to be 3 inches. The length L of the desk dam apparatus 100 can formed to any desired length depending on the desk top surface in which the desk dam apparatus 100 is to be used therewith. Generally, the desk dam apparatus 100 will have a length L of approximately 24 inches. However, the length L can be larger when intended to be used with long desk top surfaces, and can be cut to be shorter when desired.

Referring to FIGS. 1 and 2A, the desk dam apparatus 100 may also include a front groove 106 extending along the entire length L thereof at a front portion F thereof. The front groove 106 is provided to allow an edge of a desk top surface to be seated therein so that the desk dam apparatus 100 rests over the edge of a desk top. The front groove 106 can be formed to be disposed at a distance h1 from the top T of the desk dam apparatus 100 and at a distance h3 from the bottom of the desk dam apparatus 100, and to have a height h2 of approximately 1 inch, which generally corresponds with the thickness of a common desk top. However, the height h2 of the groove 106 can be formed to any height which corresponds with the thickness of a desk top in which the desk dam apparatus 100 is intended to be used. In accordance with this present exemplary embodiment, the front groove 106 is configured to be disposed along a center of the front portion F of the desk dam apparatus 100 such that a lip LP having a thickness h1 of approximately 0.5 inches is formed above the front groove 106 and a lip LP having a thickness h3 of approximately 0.5 inches is formed below the front groove 106. The lip LP can be configured to extend outward from the body B by approximately 0.5 inches. However, the lip LP can be configured to extend to a large amount from the body B depending on the desk top edge in which the desk dam apparatus 100 is intended to be used therewith.

The desk dam apparatus 100 can be made entirely of a foam-like material or similar porous structure that can be cut to a desired length, as well as being strong enough to retain electrical wires within the holes 102. The material in which the desk dam apparatus 100 is formed is also made of a material that can support a wire with display objects extending therefrom, or figurines or other display pieces, in an upright vertical manner, as will be described in more detail with respect to FIGS. 6 through 8.

In accordance with an exemplary embodiment herein, a strip of double sided adhesive 110 can be adhered along the inside of the front groove 106 along the height h2 such that when the front groove 106 is disposed over an edge of a desk top the adhesive 110 will stick to the edge of the desk top, thus adhering the desk dam apparatus 100 to the edge of the desk top. Alternatively, a hook and loop type system (i.e., Velcro®) can be used to attach the desk dam apparatus 100 to the edge of a desk top by adhering a strip of hooks or loops to the inner wall of the front groove 106 while adhering the other one of the strips of hooks or loops to the edge of the desk top such that when the strip of hooks and loops are placed in contact the desk dam apparatus 100 is adhered to the edge of the desk top.

Still referring to FIGS. 1 and 2A, the desk dam apparatus 100 may also include a rear groove 108 extending along an entire length of a rear portion R thereof. The rear groove 108 is configured to allow an insert 200 (described with reference to FIG. 2B) to be tightly fitted therein to contain the wires from being pulled out of the slits 104. The rear groove 108 can be configured similar to the front groove 106 in that rear groove 108 can be formed to be disposed at a distance h1 from the top T of the desk dam apparatus 100 and at a distance h3 from the bottom of the desk dam apparatus 100, and to have a height h2 of approximately 1 inch. In accordance with this present exemplary embodiment, the rear groove 108 is configured to be disposed along a center of the rear portion R of the desk dam apparatus 100 such that a lip LP having a thickness h1 of approximately 0.5 inches is formed above the rear groove 108 and a lip LP having a thickness h3 of approximately 0.5 inches is formed below the rear groove 108. The thickness of the lip LP can be adjusted depending on the strength of the material being used so that the upper lip LP can withstand the weight of objects being placed on the top T of the desk dam apparatus 100.

Figure 2B:
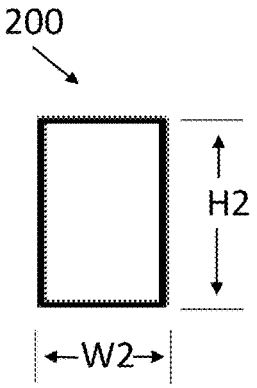
FIG. 2B illustrates a desk dam insert, in accordance with an exemplary embodiment of the present inventive concept.

FIG. 2B illustrates an insert 200 in accordance with an exemplary embodiment of the present inventive concept. In accordance with this exemplary embodiment, the insert 200 can be configured to have a height H2 of approximately 1 inch or slightly larger in order to tightly fit into the rear groove 108 of the desk dam apparatus 100. The insert 200 can also be configured to have a width W2 to correspond with a width w2 of the lip LP extending from the top and bottom of the desk dam apparatus 100. The measurements of the insert 200 can be configured to conform with the height and width of the corresponding rear groove 108 in order to tightly fit therein and remain completely within borders of the rear groove 108.

Figure 2C:
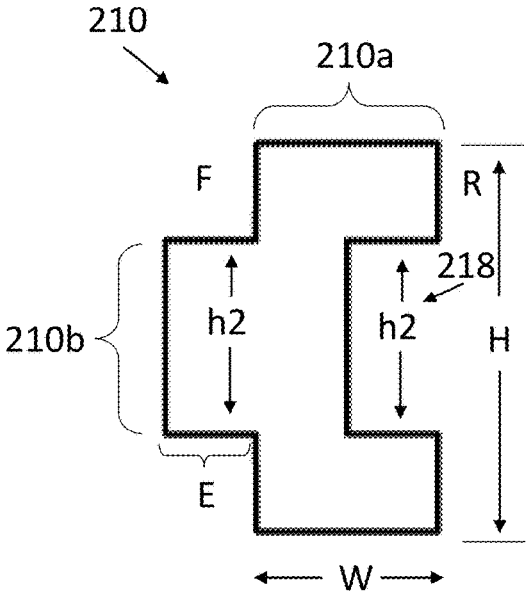
FIG. 2C illustrates a desk dam extension, in accordance with another exemplary embodiment of the present inventive concept.

FIG. 2C illustrates a desk dam apparatus extension 210 according to another exemplary embodiment of the present inventive concept. The extension 210 can include a body portion 210*a* having a height H corresponding with the height H of the desk dam apparatus 100, and a length L corresponding with the length L of the desk dam apparatus 100. The desk dam apparatus extension 210 can also include a protrusion 210*b* extending from a front portion F thereof. The protrusion 210*b* can be configured to extend from a center of the front portion F of the extension 210 along the entire length L thereof and to protrude by a length equal to the depth of the front groove 106 of the desk dam apparatus 100 such that the protrusion 210*b* fits entirely into the front groove 106 while the front portion F thereof rests against the rear portion R of the desk dam apparatus 100. A height h2 of the protrusion 210*b* can be configured to be the same as, or slightly larger than the height h2 of the front groove 106 such that the protrusion 210*b* fits tightly within the front groove 106. A width W of the desk dam apparatus extension 210 can be configured to be approximately 1 inch, and the protrusion 210*b* thereof can be configured to protrude by an amount equal to the depth of the front groove 106, which for this exemplary embodiment is approximately 0.5 inches (the same as the extent in which the lip LP is described to protrude from the body B of the desk dam apparatus 100 with reference to the exemplary embodiment of FIG. 1 and FIG. 2A). A rear groove 218 can be formed at the back of the desk dam apparatus extension 210 to receive the insert 200 therein, or to receive a protrusion 210*b* of another desk dam apparatus extension 210, as described in more detail below while referring to FIG. 2D.

Figure 2D:
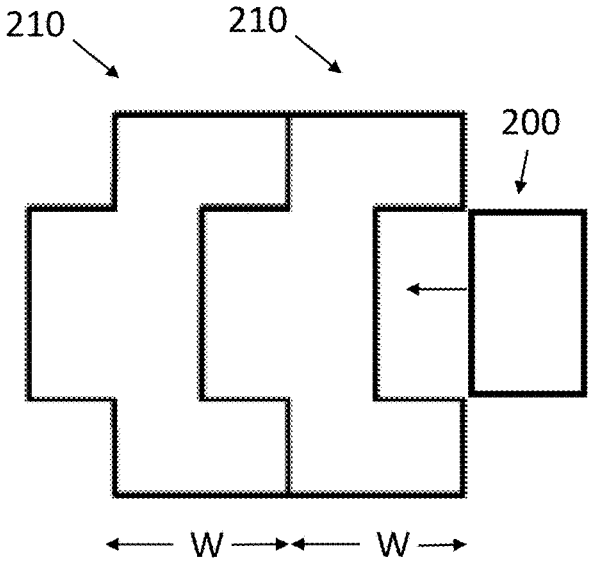
FIG. 2D illustrates the use of multiple desk dam extensions in unison, and the desk dam insert, in accordance with the exemplary embodiments of FIGS. 2B and 2C.

FIG. 2D illustrates where two desk dam apparatus extensions 210 can be engaged together, thus forming a single desk dam apparatus extension 210 with twice the width W of one desk dam apparatus extension 210. It is to be noted that with the configuration of the desk dam apparatus extension 210, multiple desk dam apparatus extensions 210 can be fitted together to fill in larger gaps that may occur between the edge of a desk top and a wall in which a desk may be placed adjacent thereto. Further, the insert 200 in accordance with the exemplary embodiment of FIG. 2B can be fitted into the last one of a plurality of desk dam apparatus extensions 210 connected together in order to close the exposed rear groove 218 of the last one of the plurality of fitted desk dam apparatus extensions 210.

It is to be noted that since the exposed rear surface R of the last one of the plurality of fitted desk dam apparatus extensions 210 will press against a wall in which the corresponding desk top surface is adjacent thereto, the combination of the desk dam apparatus 100, adhered to the edge of the desk top, together with the one or more desk dam apparatus extensions 210 will be secured between the desk top edge and a wall in which the desk is disposed adjacent thereto, thus providing a secure desk dam between an edge of a desk top and an adjacent wall.

Figure 2E:
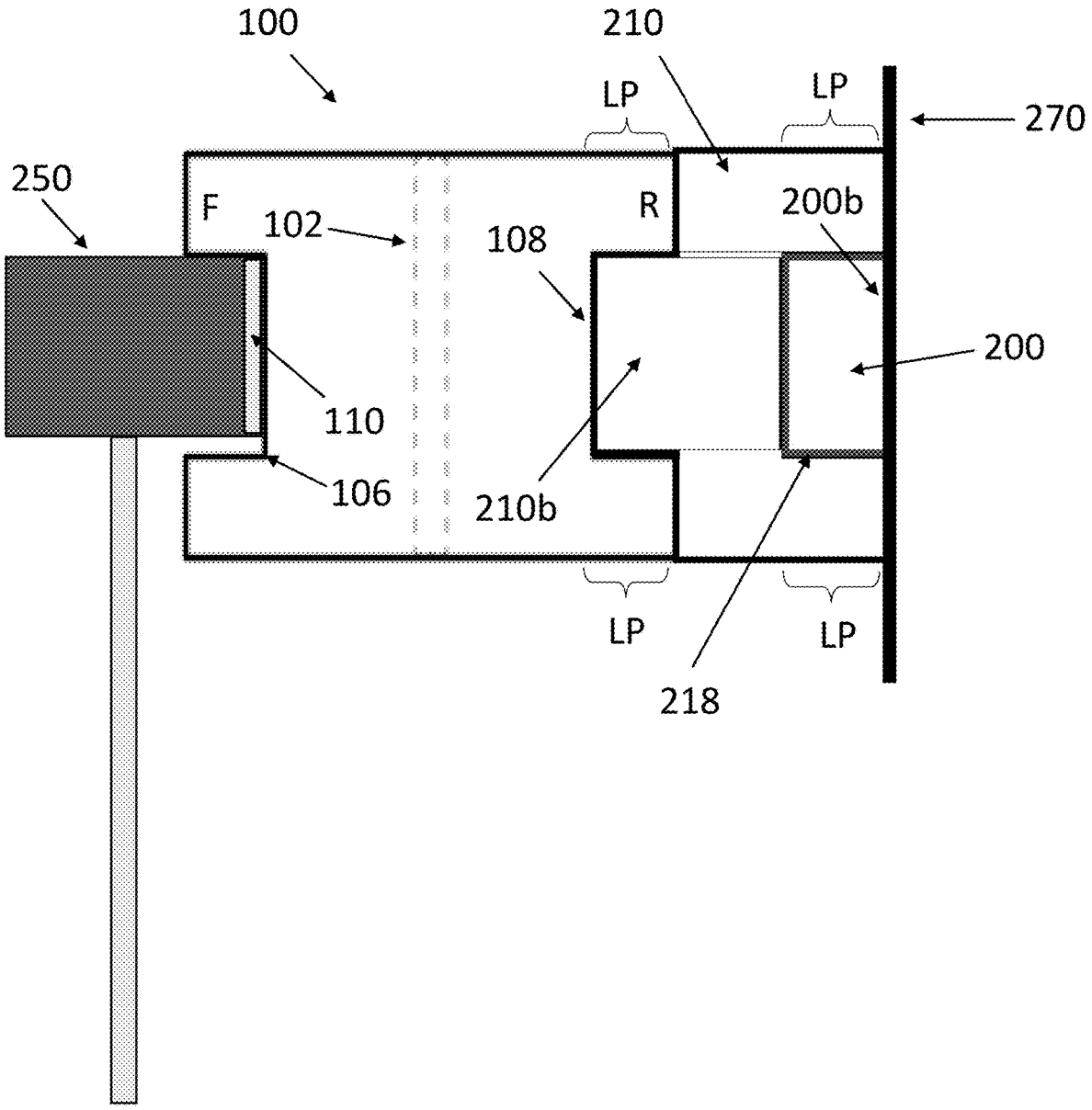
FIG. 2E illustrates a side view of the desk dam apparatus of FIG. 1 in combination with the extension of FIG. 2C and the insert of FIG. 2B.

FIG. 2E illustrates a side view of the desk dam apparatus 100 in combination with the extension 210 and the insert 200, as a system. The desk dam apparatus 100 is connected to the extension 210 by inserting the protrusion 210*b* of the extension 210 into the rear groove 108 of the desk dam apparatus 100, and the insert 200 is connected to the extension 210 by inserting the insert 200 into the rear groove 218 of the extension 210. As illustrated, the front groove 106 is slid over an edge of a desk top 250 until the adhesive 110 comes into contact with the edge of the desk top 250. The protrusion 210*b* of the extension 210 is inserted into the back groove 108 of the desk dam apparatus 100, and the insert 200 is inserted into the back groove 218 of the extension 210. Finally, a back end of the upper and lower lips LP are pressed against a wall 270, and a back surface 200*b* is also pressed against the wall 270.

Figure 3A:
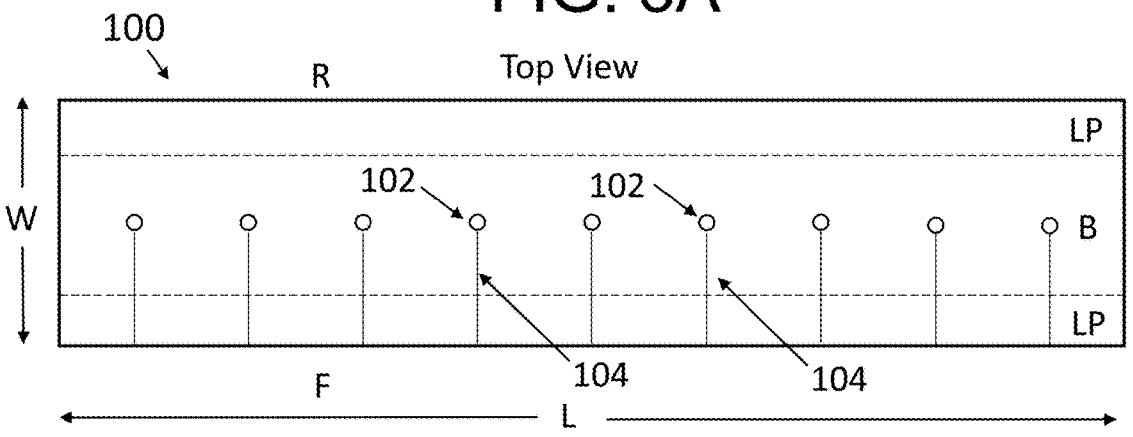
FIG. 3A illustrates a top view of the desk dam apparatus in accordance with the exemplary embodiment of FIG. 1.

FIG. 3A illustrates a top view of the desk dam apparatus 100 according to the exemplary embodiment of FIG. 1. As illustrated, the holes 102 extend completely through the desk dam apparatus 100 from top T to the bottom thereof, and the slits 104 extend from a respective hole 102 through to the rear R of the desk dam apparatus 100.

Figure 3B:
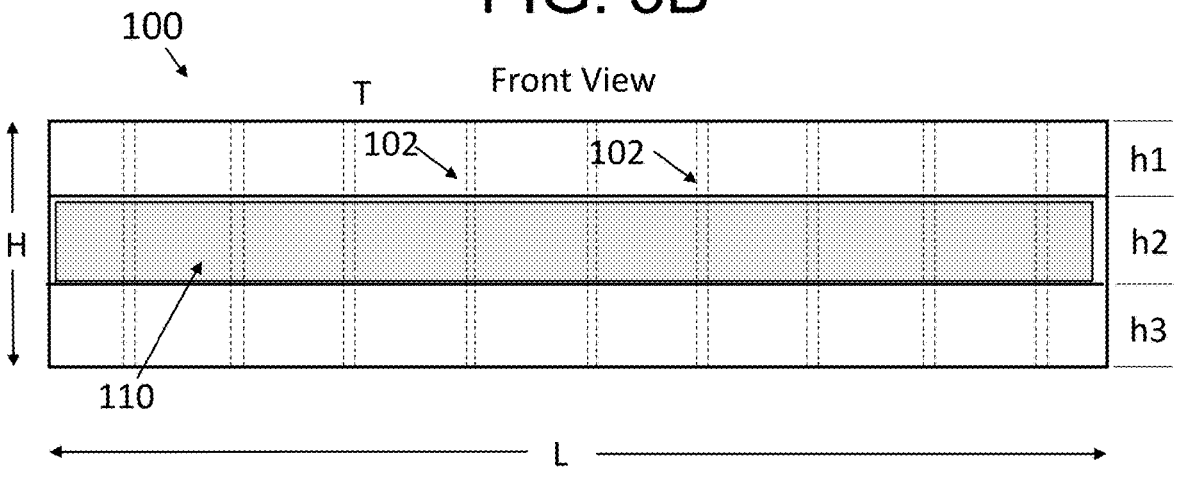
FIG. 3B illustrates a front view of the desk dam apparatus in accordance with the exemplary embodiment of FIG. 1.

FIG. 3B illustrates a front view of the desk dam apparatus 100 according to the exemplary embodiment of FIG. 1.

Figure 4A:
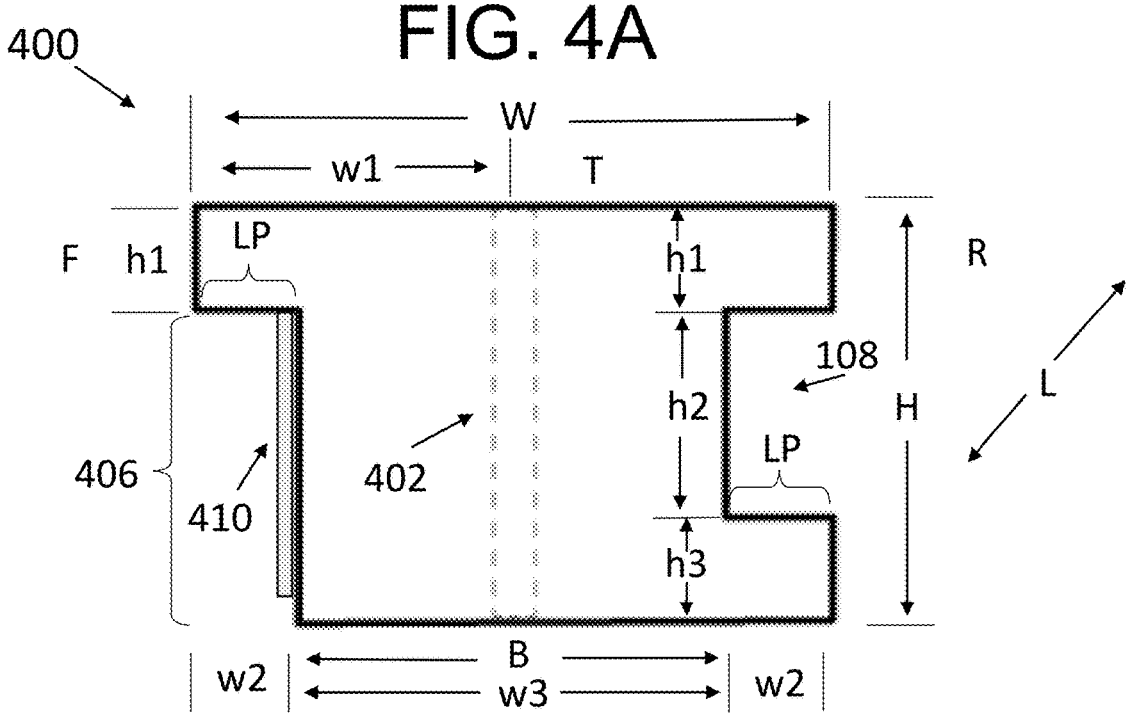
FIG. 4A illustrates a side view of a desk dam extension in accordance with another exemplary embodiment of the present inventive concept.

FIG. 4A illustrates a side view of a desk dam apparatus 400 according to another exemplary embodiment of the present inventive concept. Similar to the desk dam apparatus 100 in accordance with the exemplary embodiment of FIG. 1, the desk dam apparatus 400 is also configured to be attachable to and detachable from an edge of a desk top of a desk in order to close any gap that may exist between the desk top and a wall in which such a desk may be placed adjacent thereto.

Figure 4B:
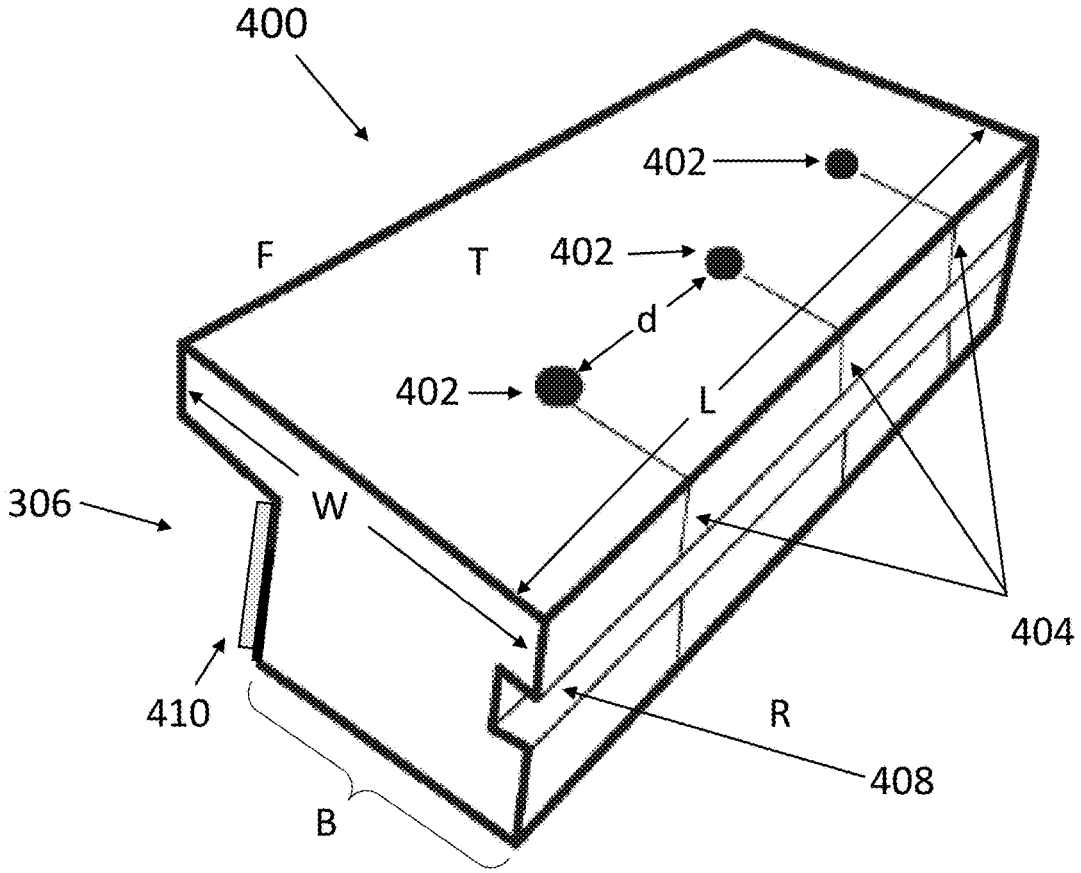
FIG. 4B illustrates a perspective view of the desk dam extension according to exemplary embodiment of FIG. 4A.

FIG. 4B illustrates a perspective view of the desk dam apparatus 400 according to the exemplary embodiment of FIG. 4A. As illustrated in FIG. 4B, the desk dam apparatus 400 may also include a plurality of holes 402 equally distanced apart and along a length L thereof. The holes 402 may extend entirely through a middle of a body portion B of the desk dam apparatus 400 from a top T to a bottom thereof, similarly to the desk dam apparatus 100 as illustrated in FIGS. 1 and 2A. The holes 402 are configured to have a diameter large enough to receive electrical wires therethrough, yet small enough to prevent electrical connectors at the ends of the wires from sliding therethrough. The holes 402 can be formed to have a diameter of approximately 0.25 inches, for example, and can be spaced apart from each other by a distance d of approximately 2 inches. However, the diameter of each hole 402 can be configured to correspond with diameters of wires intended to be used to electrically charge electronic devices seated on a desk top. Further, the distance d between adjacent holes 402 can be configured in accordance with the thickness/diameter of the wires intended to be used with the desk dam apparatus 400.

Referring to FIG. 4B, the desk dam apparatus 400 may also include a plurality of slits 404 that extend therethrough along a back portion thereof. The slits 404 can be configured to align with respective ones of the holes 402 such that an electrical wire can be slid through a slit 404 until the wire reaches and rests in a corresponding hole 402. The slits 404 are provided to allow wires to be placed in a respective hole 402 while electrical connectors, attached to an end of a corresponding wire, are too large to fit through the corresponding hole 402.

The desk dam apparatus 400 may be configured to have a height H of approximately 2 inches from a top T to a bottom thereof. The desk dam apparatus 400 may also be configured to have a width W of approximately 3 inches from a front portion F to a rear portion R thereof. Although the height H and width W of the desk dam apparatus 400 can be increased or decreased depending on the desk top to be used therewith, or the surrounding environment in which the apparatus 400 is intended to be used, for the purposes of describing this exemplary embodiment of the desk dam apparatus 400, all references to the height H thereof will be inferred to be 2 inches, and all references to the width W thereof will be inferred to be 3 inches.

The desk dam apparatus 400 may include a front notch 406 extending along an entire length of the front portion F thereof. The front notch 406 is provided to create a lip LP at a top of the front portion F of the desk dam apparatus 400 which can rest over the edge of a desk top. This exemplary embodiment of the desk dam apparatus 400 is advantageous where an edge of a desk top does not extend passed a body of the desk, thus leaving no protruding edge in which a groove, such as the front groove 106 of FIG. 1, can be tightly slid thereover. The front notch 406 can be formed at a distance h1 below the top T surface of the desk dam apparatus 400 and can extend to the bottom surface of the desk dam apparatus 400. Accordingly, since the lip LP is configured to have a height h1 of approximately 0.5 inches, similar to the height h1 of the lip LP of the desk dam apparatus 100 of FIG. 1, the front notch 406 can be configured to have a height of approximately 1.5 inches, thus extending the entire remaining height of the desk dam apparatus 400 from a bottom of the lip LP to the bottom of the desk dam apparatus 400. The height of the front notch 406 is not particularly important since this desk dam apparatus 400 according to this exemplary embodiment is not configured to enclose a protruding edge of a desk top. However, the lip LP should have a height h1 sufficient to withstand weight that may be placed on the top surface T of the desk dam apparatus 400.

Similar to the desk dam apparatus 100 according to the exemplary embodiment of FIG. 1, the desk dam apparatus 400 can be made entirely of a foam-like material or similar porous structure that can be cut to a desired length, as well as being strong enough to retain electrical wires within the holes 402. The material in which the desk dam apparatus 400 is formed is also made of a material that can support a wire with display objects extending therefrom, or figurines or other display pieces, in an upright vertical manner, as will be described in more detail with respect to FIGS. 6 through 8.

A two-sided adhesive 410 can be attached to a back wall within the front notch 406 and can extend the entire length thereof. An opposite side of the two-sided adhesive 410 can be adhered to the edge of a desk top. Alternatively, a hook and loop type system (i.e., Velcro®) can be used to attach the desk dam apparatus 400 to the edge of a desk top by adhering a strip of the hooks or loops to the inner wall of the front notch 406 while adhering the other one of the strips of hooks or loops to the edge of the desk top such that when the strip of hooks and loops are placed in contact with each other the desk dam apparatus 400 becomes adhered to the edge of the desk top.

Referring to FIGS. 4A and 4B, the desk dam apparatus 400 may also include a rear groove 408 that extends along an entire length L of a rear portion R thereof. The rear groove 408 is configured to allow an insert 200 (see FIG. 2B) to be tightly fitted therein to contain the wires from being pulled out of the slits 404. The rear groove 408 can be configured to be disposed at a distance h1 from the top T of the desk dam apparatus 400 and at a distance h3 from the bottom of the desk dam apparatus 400. The rear groove 408 can also be configured to have a height h2 of approximately 1 inch. However, the height h2 of the groove 408 can be formed to any height which corresponds with a height of the insert 200. In accordance with this present exemplary embodiment, the rear groove 108 is configured to be disposed along a center of the rear portion R of the desk dam apparatus 100 such that a lip LP having a thickness h1 of approximately 0.5 inches is formed above the rear groove 108 and a lip LP having a thickness h3 of approximately 0.5 inches is formed below the rear groove 108.

Figure 5A:
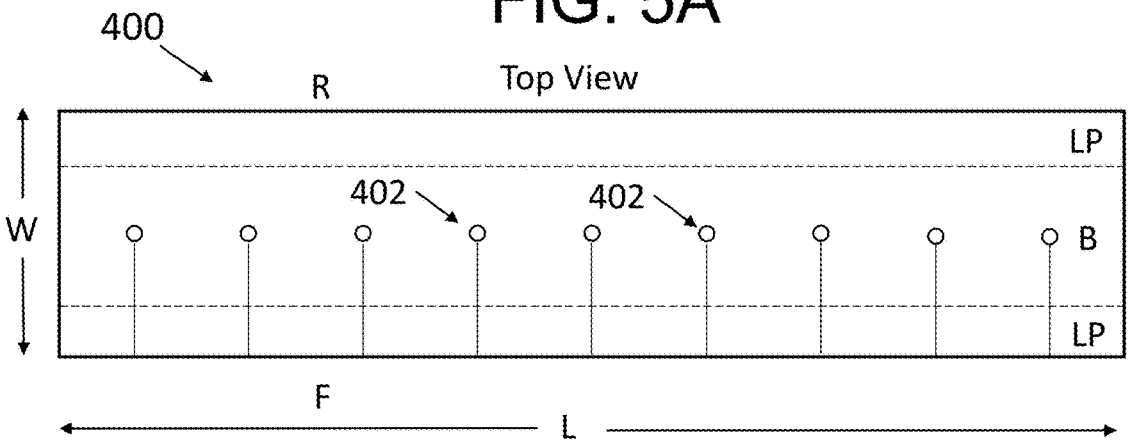
FIG. 5A illustrates a top view of the desk dam apparatus in accordance with the exemplary embodiment of FIGS. 4A and 4B.

FIG. 5A illustrates a top view of the desk dam apparatus 400 according to the exemplary embodiment of FIGS. 4A and 4B.

Figure 5B:
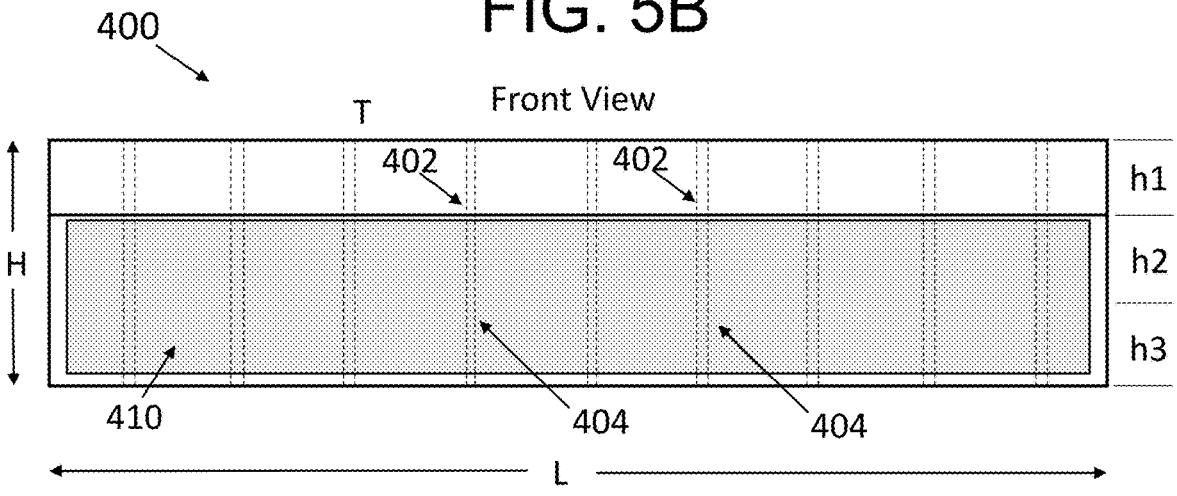
FIG. 5B illustrates a front view of the desk dam apparatus in accordance with the exemplary embodiment of FIGS. 4A and 4B.

FIG. 5B illustrates a front view of the desk dam apparatus 400 according to the exemplary embodiment of FIGS. 4A and 4B.

Figure 6:
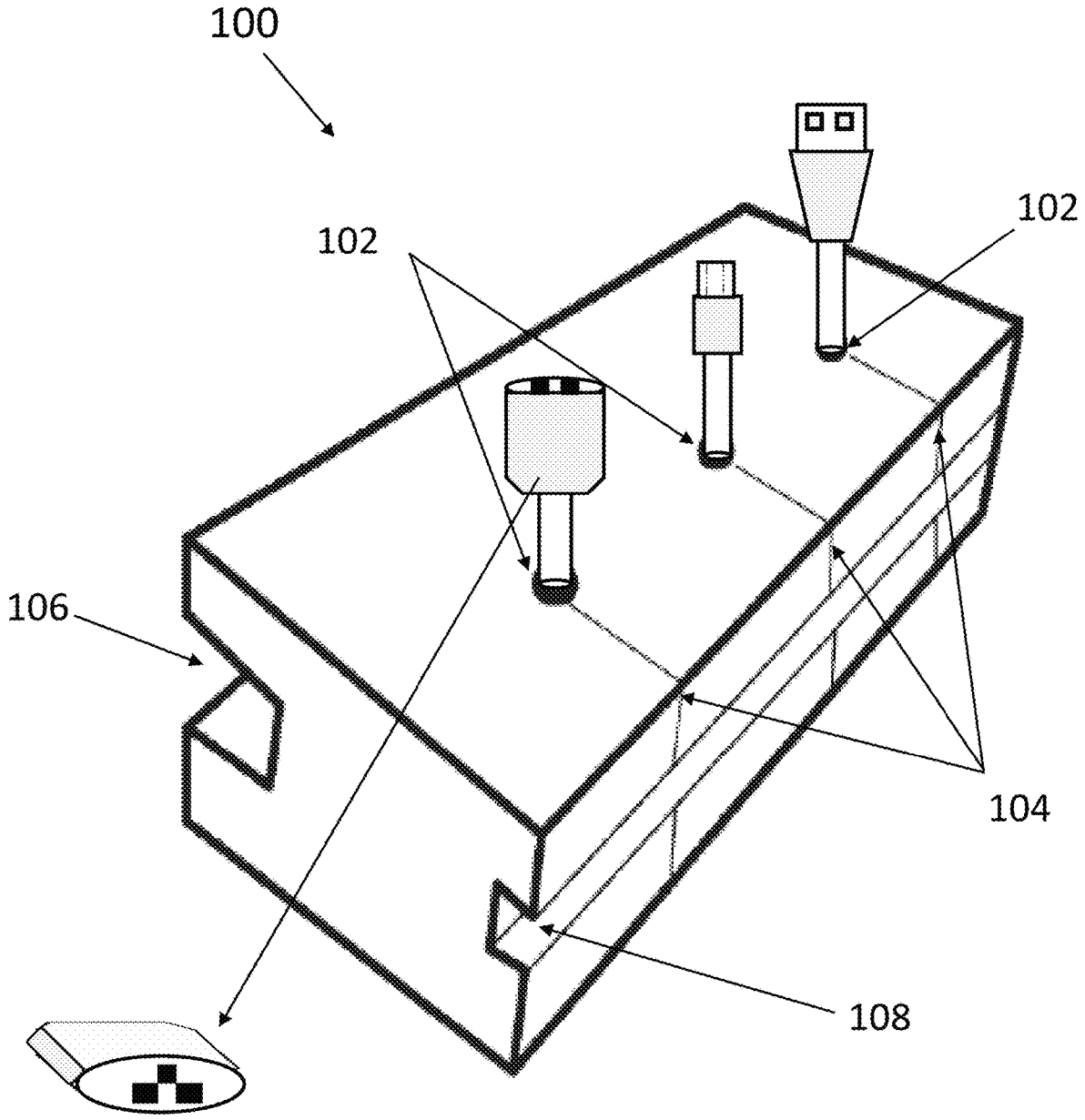
FIG. 6 illustrates prospective operational view of the desk dam apparatus of FIG. 1.

FIG. 6 illustrates the desk dam apparatus 100 according to the exemplary embodiment of FIG. 1, with electrical wires inserted into respective holes 102. For example, a common 120 volt electrical cord c1 can be inserted into a hole 102 by sliding the cord c1 through a slit 104 corresponding to the hole 102. Once the cord c1 is in the hole 102, a connector portion c1a of the electrical cord c1 is retained above the top T of the desk dam 100 since the connector portion c1a is too large to slide through the corresponding hole 102. Similarly, an electrical cord c2 used with a mobile phone or electronic tablet can be inserted into a hole 102 by sliding the cord c2 through a slit 104 corresponding to the hole 102. Once the cord c2 is in the hole 102, a connector portion c2a of the electrical cord c2 is retained above the top T of the desk dam 100 since the connector portion c2a is too large to slide through the corresponding hole 102. Similarly, a USB cord c3 can be inserted into a hole 102 by sliding the cord c3 through a slit 104 corresponding to the hole 102. Once the cord c3 is in the hole 102, a USB connector portion c3a of the electrical cord c3 is retained above the top T of the desk dam 100 since the USB connector portion c3a is too large to slide through the corresponding hole 102. It is to be noted that any type of electrical cord with a connector end can be retained in one of the plurality of holes 102 to keep the electrical cord connector above a desk top surface for easy access, this preventing electrical cords and respective connectors from sliding off a desk top surface.

Figure 7:
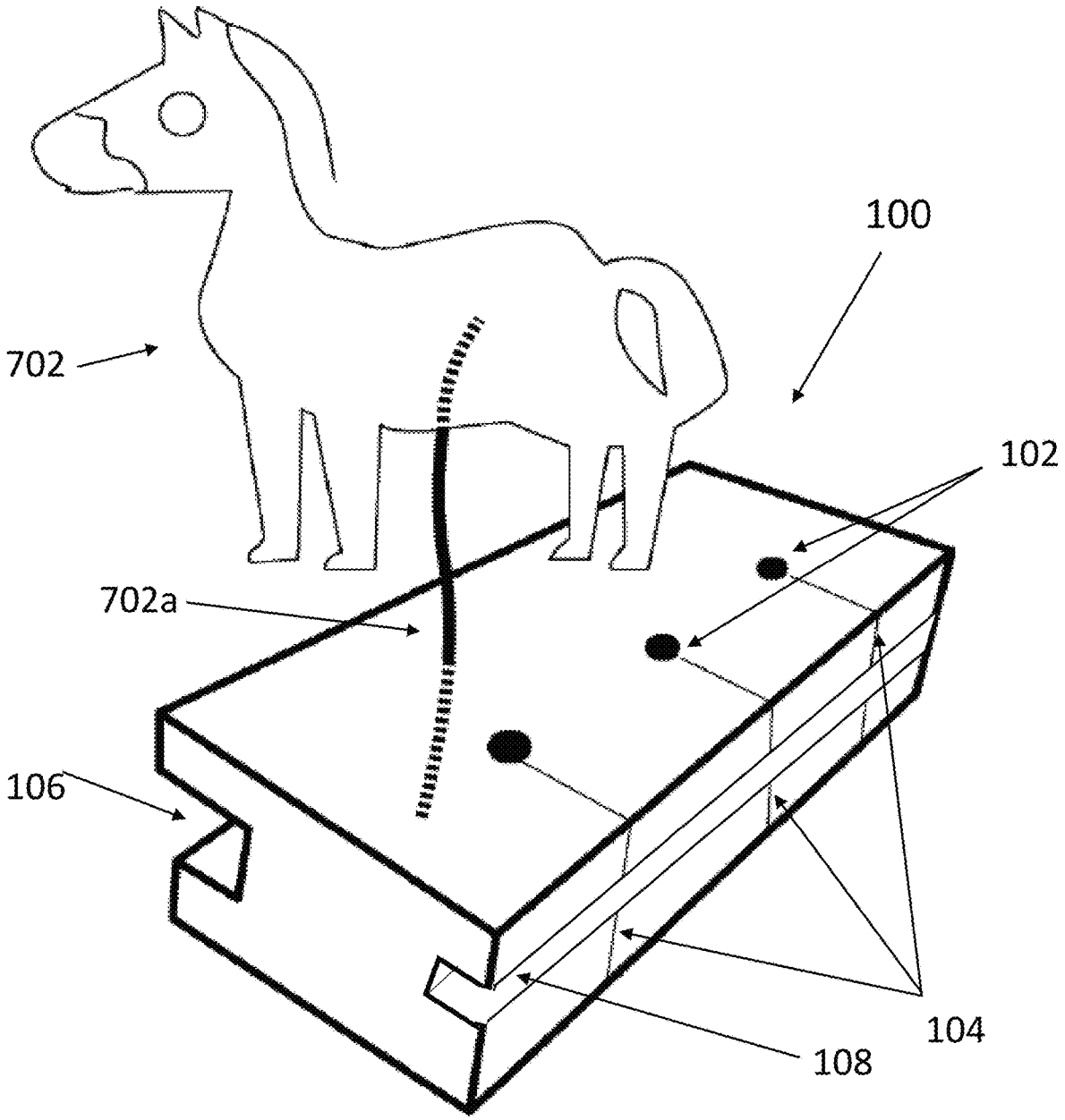
FIG. 7 illustrates another prospective operational view of the desk dam apparatus of FIG. 1.

FIG. 7 illustrates the desk dam apparatus 100 according to the exemplary embodiment of FIG. 1, with a display object 702 inserted into the body B of the desk dam apparatus 100. More specifically, any type of display object, figurine, or other display piece can be retained in an upright manner by inserting a wire 702*a*, connected to the display object 702, through a portion of the body B of the desk dam apparatus 100. Since the desk dam apparatus 100 is formed of a foam-like material or similar porous structure, the wire 702*a* can be inserted therein, while being retained in an upright manner, thus displaying the display object 702 in a floating like fashion.

It is to be noted that the desk dam apparatus 400 according to the exemplary embodiment of FIG. 4A can provide the same features and utilities as described above with respect to the desk dam apparatus 100 according to the exemplary embodiment of FIG. 1.

Figure 8:
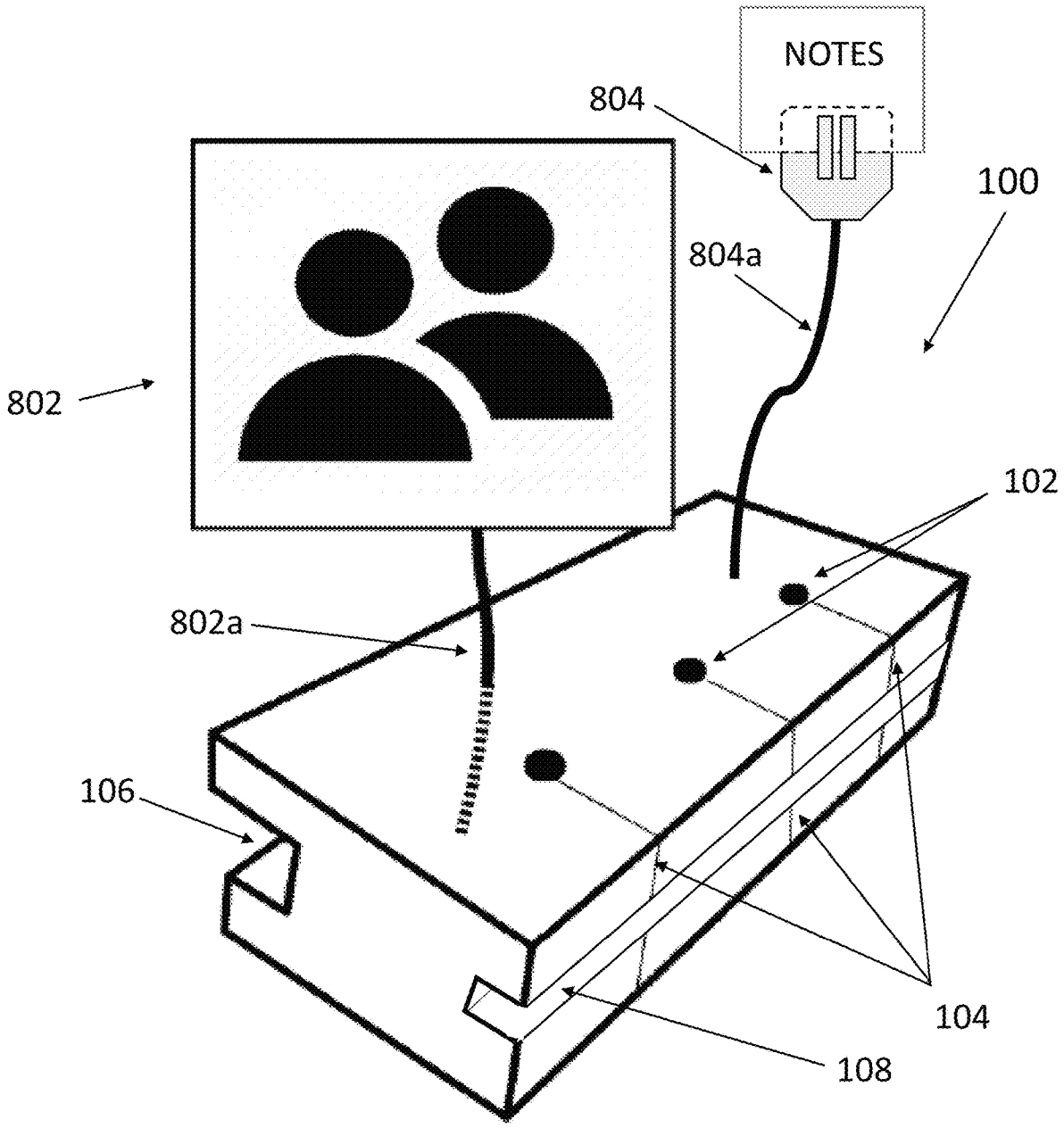
FIG. 8 illustrates still another prospective operational view of the desk dam apparatus of FIG. 1.

FIG. 8 illustrates the desk dam apparatus 100 according to the exemplary embodiment of FIG. 1, with a display object 802 inserted into the body B of the desk dam apparatus 100 as well as a note sheet or other type of paper holder 804. More specifically, any type of display object, figurine, note sheet holder, or other display piece can be retained in an upright manner by inserting a wire 802*a*, 804*a*, connected to the display object 802 or not sheet holder 804, respectively, through a portion of the body B of the desk dam apparatus 100. Since the desk dam apparatus 100 is formed of a foam-like material or similar porous structure, the wires 802*a* and 804*a* can be inserted therein, while being retained in an upright manner, thus displaying the display objects, figurines, note sheet holders, etc., in a floating like fashion.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A desk top edge attachment apparatus to retain electrical wires above a surface of the desk top and in an organized manner and to partially receive therein and maintain display objects thereon in an upright manner, the apparatus comprising:

a body including:

a predetermined length, width and height;

a plurality of holes extending therethrough from a top to a bottom thereof and spaced apart by a predetermined distance along the length thereof to receive and retain electrical wires therethrough;

a plurality of slits corresponding with and aligned with respective ones of the plurality of holes, the slits extending from the respective hole through a back surface of the body;

a first groove extending along a front face of the body along a lower portion of the length thereof to form a front top lip protruding outwardly above the groove such that the lip rests on a surface of the desk top; and a second groove extending along a back face of the body along the length thereof to form a back top lip protruding from a top of the second groove and a back bottom lip protruding from a bottom of the second groove, the second groove being configured to receive and frictionally retain therein an insert formed of substantially the same dimensions as the second groove to block wires received therein from being removed through the respective slits; and an extension member having a height and length substantially equal to the height and length of the desk top edge attachment apparatus body, the extension member including:

a protruding member which protrudes from a front surface and along a length thereof and is configured to have substantially the same dimensions as the second groove and to be inserted into and frictionally retained within the second groove of the body of the desk top edge attachment apparatus; and a back groove formed in a back surface along a length thereof and configured to receive a protruding member of another extension member or an insert having substantially the same dimensions as the protruding member.

2. The apparatus according to claim 1, further comprising:

an adhesive material attached along the length of a back wall of the first groove to adhere to a side edge of a desk top.

3. The apparatus according to claim 2, wherein the adhesive material is a double-sided tape.

4. The apparatus according to claim 2, wherein the adhesive material includes a strip of hooks and a strip of loops, each strip having an adhesive on a back side to stick to the back wall of the first groove or the side edge of the desk top.

5. The apparatus according to claim 1, further comprising:

an insert having a height, length and width substantially equal to the height, length and width of the second groove, the insert being configured to be frictionally retained within the second groove to block the slits.

6. The apparatus according to claim 1, wherein the predetermined width of the body from the edge of the front top lip to the edge of the back top lip is three inches, and the width of the body between the front groove and the back groove is two inches.

7. The apparatus according to claim 6, wherein the predetermined height of the body is two inches, such that the height of the front top lip is one half inch, the height of the front groove is one and one half inches, and the height of the back top and bottom lips are one half inch and the height of the second groove is one inch.

8. A desk top edge securement apparatus to retain connector ends of electrical wires above a surface of the desk top and in an organized manner and to partially receive therein and maintain display objects thereon in an upright manner, the apparatus comprising:

a body including:

a plurality of holes extending from a top to a bottom thereof, each of the plurality of holes being spaced apart by a predetermined distance along a length thereof, the holes being configured to receive and retain electrical wires therethrough;

a plurality of slits aligned with and corresponding with a respective one of the plurality of holes, the slits extending from the respective hole through a back surface of the body;

a front upper lip protruding outward from a top portion of a front side thereof and along the length thereof; and a back groove extending along a back side thereof and along the length thereof to form an upper back lip protruding from a top portion of the body and a lower back lip protruding from a bottom portion of the body, the back groove being configured to frictionally receive and retain therein an insert formed of substantially the same dimensions as the back groove to block wires received in the holes from being removed through the respective slits; and an extension member having a height and length equal to the height and length of the desk top edge attachment apparatus body, the extension member including:

a protruding member which protrudes from a front surface and along a length thereof and is configured to have substantially the same dimensions as the back groove and to be frictionally inserted into the back groove of the body of the desk top edge attachment apparatus; and a back groove formed in a back surface along a length thereof and configured to frictionally receive and retain a protruding member of another extension member therein or an insert having substantially the same height, width and length therein.

9. The apparatus according to claim 8, further comprising a two-sided adhesive having the first side attached along the length of the front side of the body under the front upper lip and a second side configured to attach to a side of a desk such that the front lip rests on a desk top surface.

10. The apparatus according to claim 9, wherein the predetermined width of the body and upper front and back lips is three inches, and the width of the body is two inches from the front side thereof under the front upper lip to a back wall of the second groove.

11. The apparatus according to claim 10, wherein the predetermined height of the body is two inches, such that the height of the front top lip is one half inch, the height of the back top and bottom lips are one half inch and the height of the second groove is one inch.

12. A desk top edge attachment system to retain electrical wires above a surface of the desk top and in an organized manner and to receive and maintain display objects thereon in an upright manner, the apparatus comprising:

a body including:

a plurality of holes extending vertically through a center portion thereof along a length thereof, the plurality of holes being spaced apart by a predetermined distance and configured to receive and retain electrical wires therethrough;

a plurality of slits corresponding with and aligned with respective ones of the plurality of holes, the slits extending from the respective hole through a back surface of the body;

a front upper lip protruding outward from a top portion of a front side thereof and along the length thereof; and a back groove extending along a back side thereof and along the length thereof to form a back upper lip protruding from a top of the body and a back lower lip protruding from a bottom of the body; and an extension member having a height and length equal to a height and length of the desk top edge attachment apparatus body, the extension member including:

a protruding member which protrudes from a front surface along a length thereof and is configured to be inserted into the back groove of the body of the desk top edge attachment apparatus; and a back groove formed in a back surface along a length thereof and configured to receive a protruding member of another extension member.

13. The system according to claim 12, further comprising:

a two-sided adhesive having the first side attached along the length of the front side of the body under the front lip and a second side configured to attach to a side of a desk such that the front lip rests on a desk top surface.

14. The system according to claim 13, further comprising:

an insert having a height, length and width equal to the height, length and width of the back groove of the body and the back groove of the extension to tightly fit into the back groove of the body to close off the slits and to tightly fit into the back groove of the extension.

15. The system according to claim 13, wherein the body further comprises:

a front lower lip protruding outward from a bottom portion of the front side thereof and along the length thereof, the front lower lip and the front upper lip forming a front groove therebetween having a back wall in which the two-sided adhesive attaches thereto, the front groove being configured to slide over a protruding edge of a desk top.

16. The system according to claim 15, wherein the body has a width of two inches and a height of two inches, the front upper lip and back upper and lower lips protrude from the body by approximately one half inch and have a height of one half inch, and the back groove has a height of approximately two inches and a width of approximately one half inch.

17. The system according to claim 16, wherein the front groove has a height of one inch and a width of one half inch.

18. The system according to claim 16, further comprising:

an insert having a height, length and width equal to the height, length and width of the back groove of the body and the back groove of the extension to tightly fit into the back groove of the body to close off the slits and to tightly fit into the back groove of the extension.

* * * * *